US008820036B2

(12) United States Patent
Collins

(10) Patent No.: US 8,820,036 B2
(45) Date of Patent: Sep. 2, 2014

(54) PROCESS AND APPARATUS FOR PACKAGING BAGS

(75) Inventor: Michael Paul Collins, Denmark, WI (US)

(73) Assignee: Reynolds Presto Products Inc., Richmond, VA (US)

( * ) Notice: Subject to any disclaimer, the term of this patent is extended or adjusted under 35 U.S.C. 154(b) by 572 days.

(21) Appl. No.: 13/162,085

(22) Filed: Jun. 16, 2011

(65) Prior Publication Data

US 2012/0317926 A1 Dec. 20, 2012

(51) Int. Cl.

| | |
|---|---|
| ***B65B 63/04*** | (2006.01) |
| ***B65B 25/14*** | (2006.01) |
| ***B65B 63/00*** | (2006.01) |
| ***B65B 27/08*** | (2006.01) |

(52) U.S. Cl.

CPC ..... *B65B 25/14* (2013.01); *B65B 63/00* (2013.01); *B65B 27/08* (2013.01)

USPC ..... 53/430; 53/116; 53/202; 53/399; 53/473

(58) Field of Classification Search

CPC .. B65B 11/045; B65B 2220/18; B65B 25/14; B65B 25/146; B65B 27/08; B65B 63/00; B65B 63/04; B65B 63/06; B65B 63/024; B65B 13/02

USPC ..... 53/116, 118, 119, 202, 399, 430, 447, 53/473

See application file for complete search history.

(56) References Cited

U.S. PATENT DOCUMENTS

| | | | | |
|---|---|---|---|---|
| 1,643,091 | A * | 9/1927 | Rosenthal et al. | 53/587 |
| 2,052,854 | A * | 9/1936 | Taylor | 53/260 |
| 3,525,444 | A | 8/1970 | Brockmüller | |
| 3,672,265 | A | 6/1972 | Schwarzkopf | |
| 3,984,271 | A * | 10/1976 | Gilbu | 156/174 |
| 4,079,574 | A | 3/1978 | Monguzzi et al. | |
| 4,115,913 | A * | 9/1978 | Moriya et al. | 29/450 |
| 4,472,923 | A * | 9/1984 | Herrington | 53/429 |
| 4,601,154 | A | 7/1986 | Ausnit | |
| 4,905,453 | A | 3/1990 | Siebring | |
| 5,459,979 | A * | 10/1995 | Tommasi | 53/439 |
| 5,493,841 | A | 2/1996 | Van Wegen et al. | |
| 5,775,059 | A | 7/1998 | Hampton et al. | |
| 6,023,913 | A * | 2/2000 | Gray et al. | 53/399 |
| 6,212,855 | B1 | 4/2001 | Yasunaga et al. | |
| 6,305,146 | B1 * | 10/2001 | Gerber | 53/116 |
| 6,349,525 | B1 * | 2/2002 | Veith | 53/429 |
| 6,732,492 | B2 * | 5/2004 | Osborne et al. | 53/429 |
| 6,810,643 | B1 | 11/2004 | Gecic et al. | |
| 2001/0039785 | A1 * | 11/2001 | Greenwell et al. | 53/429 |
| 2006/0006274 | A1 | 1/2006 | Holub et al. | |

* cited by examiner

*Primary Examiner* — Hemant M Desai
(74) *Attorney, Agent, or Firm* — Merchant & Gould P.C.

(57) ABSTRACT

A method for packaging bags includes providing a plurality of bags arranged in a stack; moving the stack of bags to a tube; rotating the stack of bags to form a rolled set of bags; and moving the rolled set of bags into a packaging container. A system for carrying out the method includes a plate having an open gap sized to support the stack of bags over the open gap; a tube having a longitudinal slot oriented to receive the stack of bags; a finger arrangement to move the stack of bags into the tube and then rotate the stack into a rolled set; and a push member to move the rolled set of bags into a packaging container.

14 Claims, 8 Drawing Sheets

PROCESS AND APPARATUS FOR PACKAGING BAGS

TECHNICAL FIELD

This disclosure relates to a process, system, and apparatus for packaging bags into a packaging container, such as a carton or cardboard box. In particular, this disclosure relates to an automation method and system for packaging a rolled set of bags into a packaging container.

BACKGROUND

Bags, such as reclosable plastic bags, are often sold in packaging in the form of a rectangular carton. How to collect the bags together in a form for packaging in the carton is one of the factors to consider when making bags. Existing practices have included rolling a stack of bags into a bundle and then tying and knotting the bundle. See, for example U.S. Pat. No. 4,601,154 to Ausnit, incorporated herein by reference.

One problem with existing practices is that the process used is not repeatable enough to efficiently automate. Improvements are desirable.

SUMMARY

In general, the method and system of automating will use a loading tube that allows for the capture of bags. The bags are then rotated within the tube. The rolled set of bags is then moved into a packaging container, such as a carton.

A stack of bags is rolled and controlled. A loading tube is used to load the rolled stack of bags into packaging.

In general, a method for packaging bags includes providing a plurality of bags arranged in a stack; moving the stack of bags into a tube; rotating the stack of bags to form a rolled set of bags; and moving the rolled set of bags into a packaging container.

In one example, the step of moving the stack of bags into a tube includes moving the stack through a longitudinal slot in the tube.

In one example, the step of moving the rolled set of bags into a packaging container includes pushing an axial end of the rolled set of bags through an open end of the tube and into the packaging container.

In one example, the step of providing a plurality of bags arranged in a stack includes holding the stack of bags on a plate across an open gap, and the step of moving the stack of bags into a tube includes grabbing the stack by squeezing the stack between a pair of fingers and moving the grabbed stack through the gap in the plate and through a longitudinal slot in the tube.

In one example, the step of moving the stack of bags into a tube includes grabbing the stack by squeezing the stack between a pair of fingers.

In one example, the step of rotating includes rotating the pair of fingers, while the pair of fingers is squeezing the stack, to rotate the stack and form the rolled set of bags.

Preferably, the step of rotating occurs while the stack is within the tube.

In one example, after the step of rotating and before the step of moving the rolled set of bags, there is the step of removing the pair of fingers from the rolled set of bags. Preferably, the step of removing the pair of fingers from the rolled set of bags includes separating the fingers to release the squeeze.

In preferred methods, there is further the step of transporting the tube holding the rolled set of bags to a loading station, which occurs after the step of removing the pair of fingers from the rolled set of bags.

In one example, the step of moving the rolled set of bags into a packaging container includes, at the loading station, using a pusher to engage through a first open end of the tube an axial end of the rolled set of bags and pushing the rolled set of bags from the tube through a second open end of the tube and into the packaging container.

In another aspect, a system for packaging bags is provided. The system includes a plate having a holding surface with an open gap through the holding surface, the holding surface being sized to support a stack of bags over the open gap. The system includes a tube having a longitudinal slot oriented to receive the stack of bags. There is a pair of fingers positionable to squeeze the stack of bags and move the stack through the gap in the holding surface and into the tube through the slot. The fingers are rotatable to rotate the stack of bags to form a coil or a rolled set of bags while in the tube. The system also includes a push member to move the rolled set of bags into a packaging container.

Preferably, the system includes a conveyor to transport the tube to the push member.

It is noted that not all the specific features described herein need to be incorporated in an arrangement for the arrangement to have some selected advantage according to the present disclosure.

It is to be understood that both the foregoing general description and the following detailed description are exemplary and explanatory only and are not restrictive of the invention, as claimed. The accompanying drawings, which are incorporated in and constitute a part of this specification, illustrate example embodiments of the invention and together with the description, serve to explain the principles of the invention.

DETAILED DESCRIPTION

Figure 1:
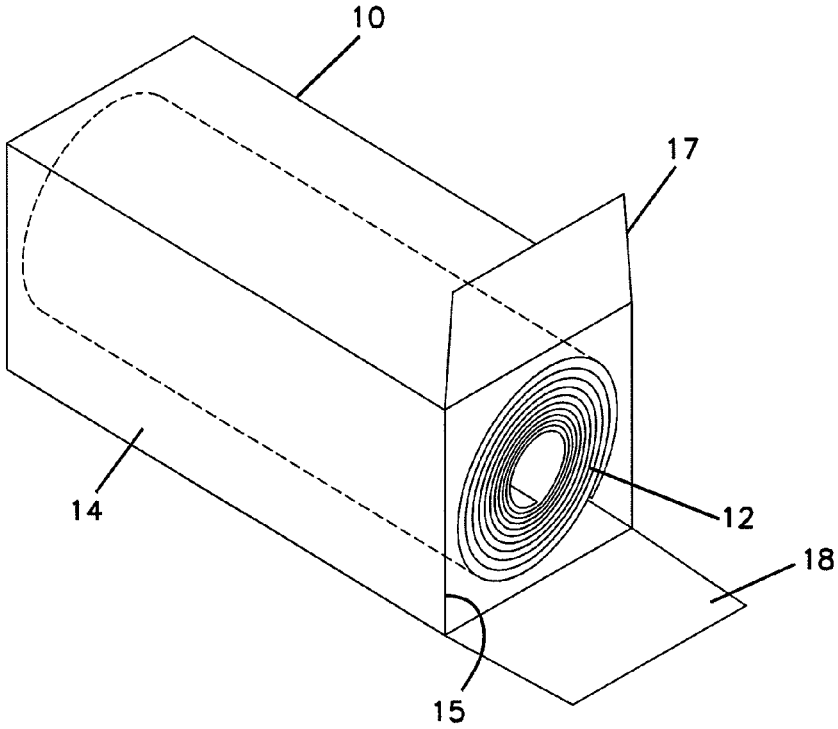
FIG. 1 is a schematic, perspective view of a packaging container, such as a carton, holding a rolled set of bags, packaged in accordance with principles of this disclosure.

FIG. 1 illustrates a perspective view of a packaging container 10 holding a rolled set of bags 12. The packaging container 10 can include, for example, a cardboard carton 14 defining an interior volume 15. The rolled set of bags 12 may include, for example, plastic bags, such as reclosable plastic bags, rolled or coiled into the rolled set 12 and placed inside the interior volume 15 of the carton 14. The carton 14 can include end flaps 17, 18, which may be folded to cover the rolled set of bags 12 and hold the rolled set of bags 12 within the interior volume 15. In FIG. 1, the carton 14 is shown as a generally rectangular carton, as is standard in the art.

Figure 2:
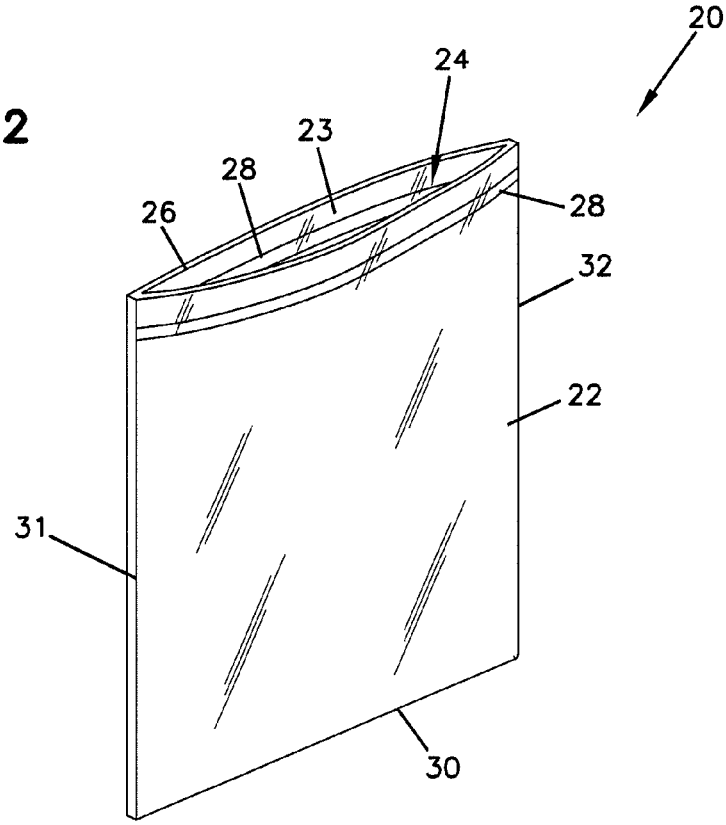
FIG. 2 is a schematic, perspective view of one example of a bag that is used in the method and system for packaging.

The bags used can be any type of flexible bag, including plastic sandwich bags, disposer bags (e.g. 4 gallon disposer bags), fold and close bags, and plastic reclosable bags (e.g., zipper closure bags, single or double zipper). One example of a plastic reclosable bag is shown in FIG. 2 at 20. The bag 20 may be a type that is standard in the art, made from a polymeric material and having first and second opposing walls 22, 23 defining an open bag interior volume 24. A mouth 26 can be opened and closed to provide access and close access to the interior volume 24. The bag 20 may also include a zipper 28 to selectively and releasably lock closed the mouth 26. In the embodiment shown, the first wall 22 and second wall 23 each have half of the zipper closure 28, such that they may be pressed together and interlocked in order to close the mouth 26. As can be seen in FIG. 2, the bag 20 includes a bag bottom 30 at an end opposite of the mouth 26. There are also first and second edges 31, 32 extending between the mouth 26 and the bottom 30.

Figure 10:
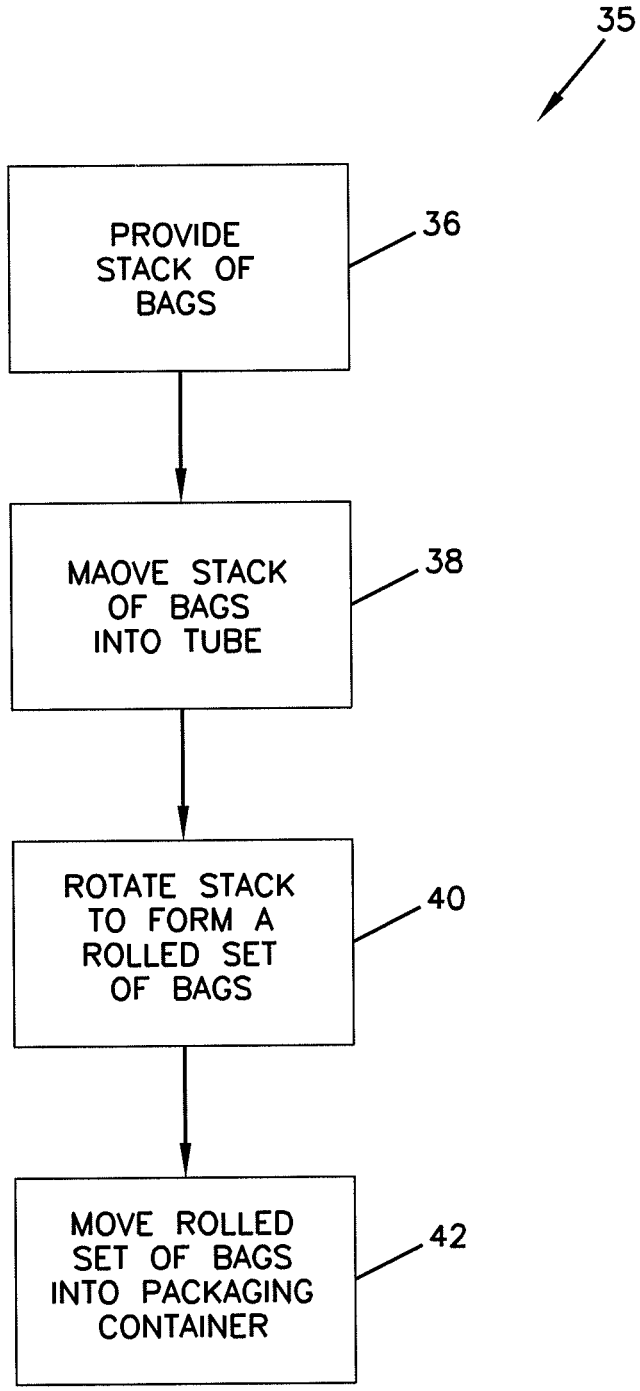
FIG. 10 is a flow chart showing one example method, in accordance with principles of this disclosure.

FIG. 10 is a flow chart of one example method for packaging bags to result in the form shown in FIG. 1, for example. The method 35 begins with a stack of bags. The bags can be bags such as the ones shown in FIG. 2 at 20. They may also be any type of flexible bag. Preferably, the bags 20 are arranged in a vertical stack, one on top of each other in step 36. While the bags 20 need not be precisely in alignment with each other, preferably, the bags 20 are stacked neatly on top of each other in the same orientation. For example, this includes the bottoms 30 of each adjacent bag being next to each other, while the first and second edges 31, 32 and mouth 26 of each adjacent bag is next to each other.

Next, there is a step 38 of moving the stack of bags into a tube. The tube will help to keep control of the stack of bags for further manipulation. After the step 38 of moving the stack of bags into a tube, there is a step 40 of rotating the stack of bags to form a rolled set of bags. Specifically, in order to get the bags to fit into the carton 14, in an efficient and compact manner, the stack of bags is rolled about itself, or coiled, to form a roll of bags. Next, there is a step 42 of moving the rolled set of bags into the packaging container 10, such as carton 14.

Figure 3:
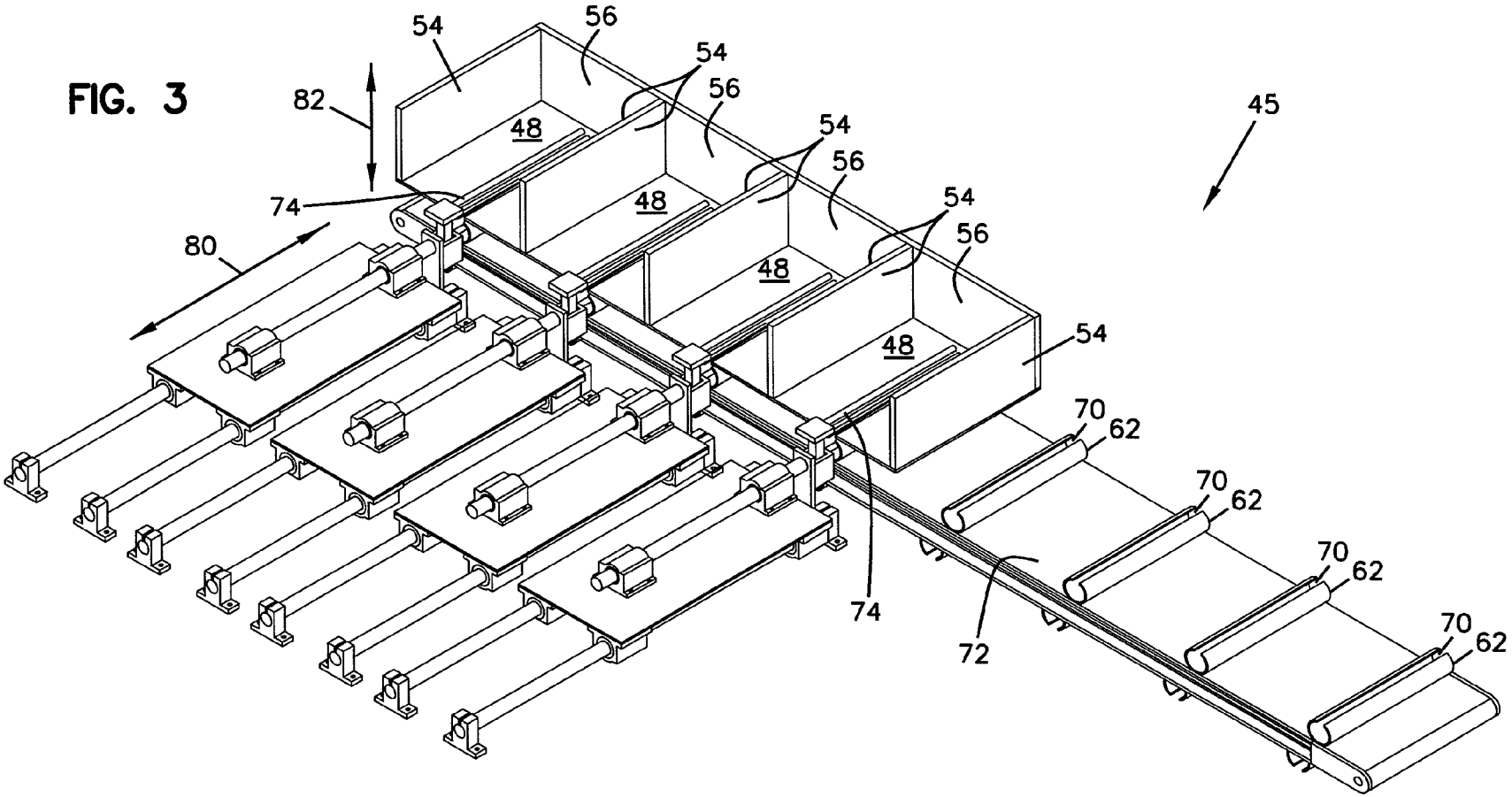
FIG. 3 is a schematic, perspective view of a part of the system for packaging bags, constructed in accordance with principles of this disclosure.

In reference now to FIGS. 3-9, example schematic representations of components used in a system 45 for carrying out the method 35 for packaging bags are shown. In FIG. 3, a portion of the example system 45 for carrying out the method 35 is shown as including a plate 48. In FIG. 3, four plates 48 are shown. In the example shown, each plate 48 includes a holding surface 50, which is generally a flat platform 52. Side walls 54 extend around the holding surface 50 to form a cradle or nest 56. The nest 56 contains or holds the bag stack 58 (FIG. 4) on the holding surface 50.

In FIG. 3, there are four plates 48 oriented adjacent to each other, in a side-by-side relationship, sharing a common side wall 48. In other embodiments, there can be more or fewer plates 48.

In the example shown, each plate 48 includes an open gap 60 (FIGS. 4 and 5) through the holding surface 50. The holding surface 50 is sized to support the stack 58 of bags over the open gap 60. The stack 58 will include at least two bags 20, and more typically, 10-300 bags.

Figure 4:
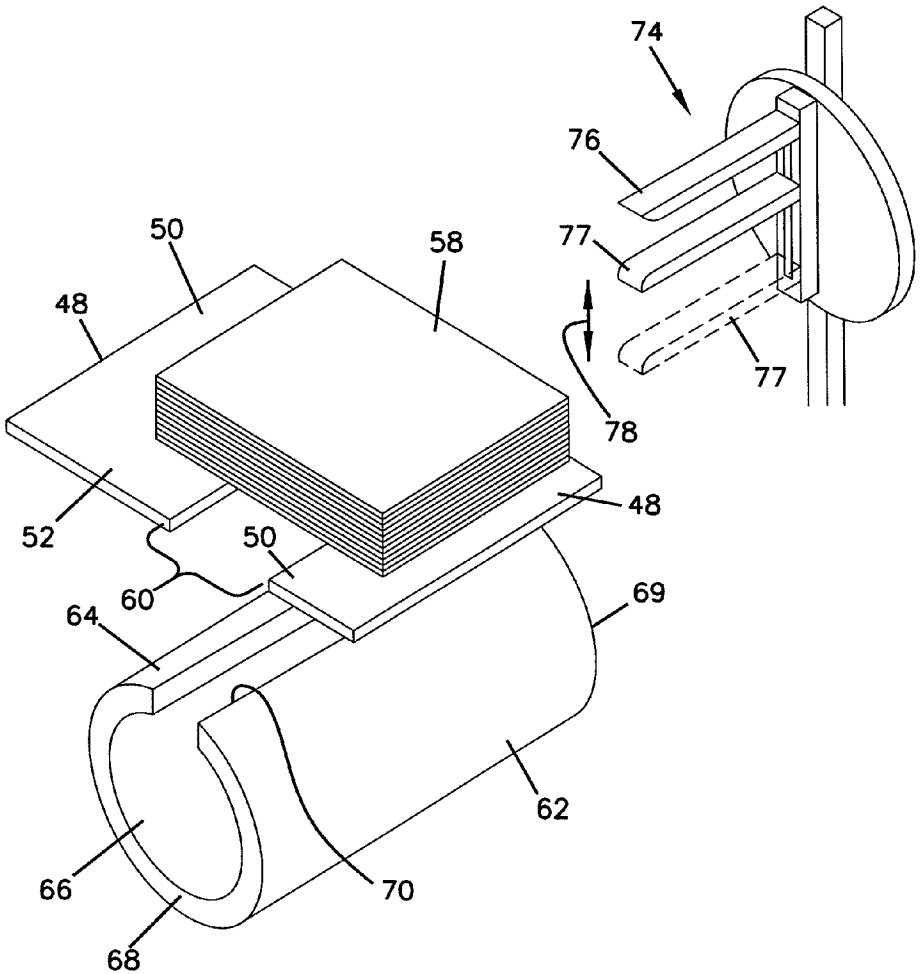
FIG. 4 is a schematic, perspective view of portions of the system used in the method for packaging bags, in accordance with principles of this disclosure.
Figure 5:
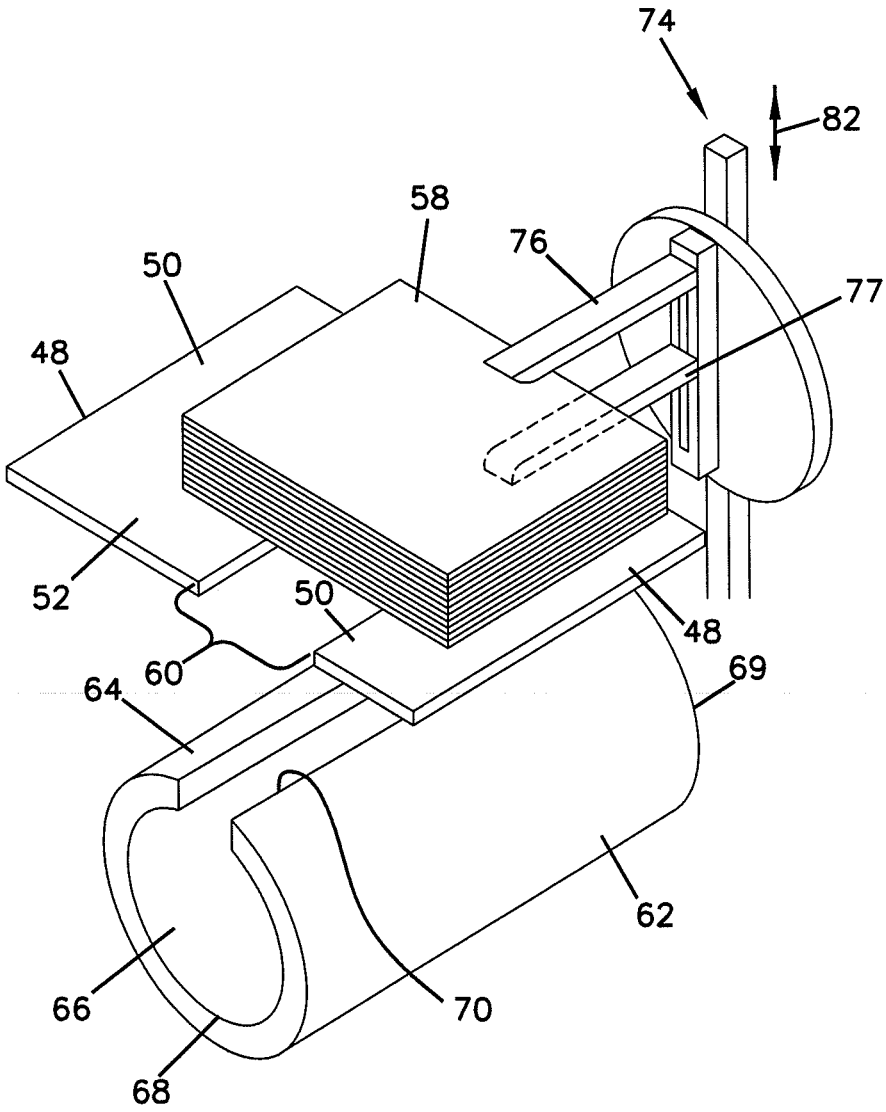
FIG. 5 is a schematic, perspective view of the system components of FIG. 4 during another step of the method for packaging bags, in accordance with principles of this disclosure.

The system 45 further includes a loading tube 62. In the embodiment shown, the loading tube 62 is generally cylindrical in shape. The tube 62 includes a curved wall 64 (FIGS. 4 and 5) defining an inner volume 66. The wall 64 has an open first end 68 and open second end 69 in communication with the interior volume 66. As can be seen in FIGS. 4 and 5, the wall 64 preferably has an opening or slot 70 extending longitudinally between the first end 68 and second end 69. The slot 70 communicates with the interior volume 66.

In FIG. 3, one example setup shows a plurality of tubes 62 being movable or transported on a conveyor belt 72. In the embodiment of FIG. 3, there is a loading tube 62 oriented beneath each one of the plates 48. The tube 62 has a size sufficient to receive the stack 58 of bags within the interior volume 66.

The system 45 further includes a finger arrangement 74. The finger arrangement 74 is positionable to squeeze the stack 58 and move the stack through the gap 60 in the holding surface 50 of the plate 48 and into the tube 62 through the slot 70.

Figure 6:
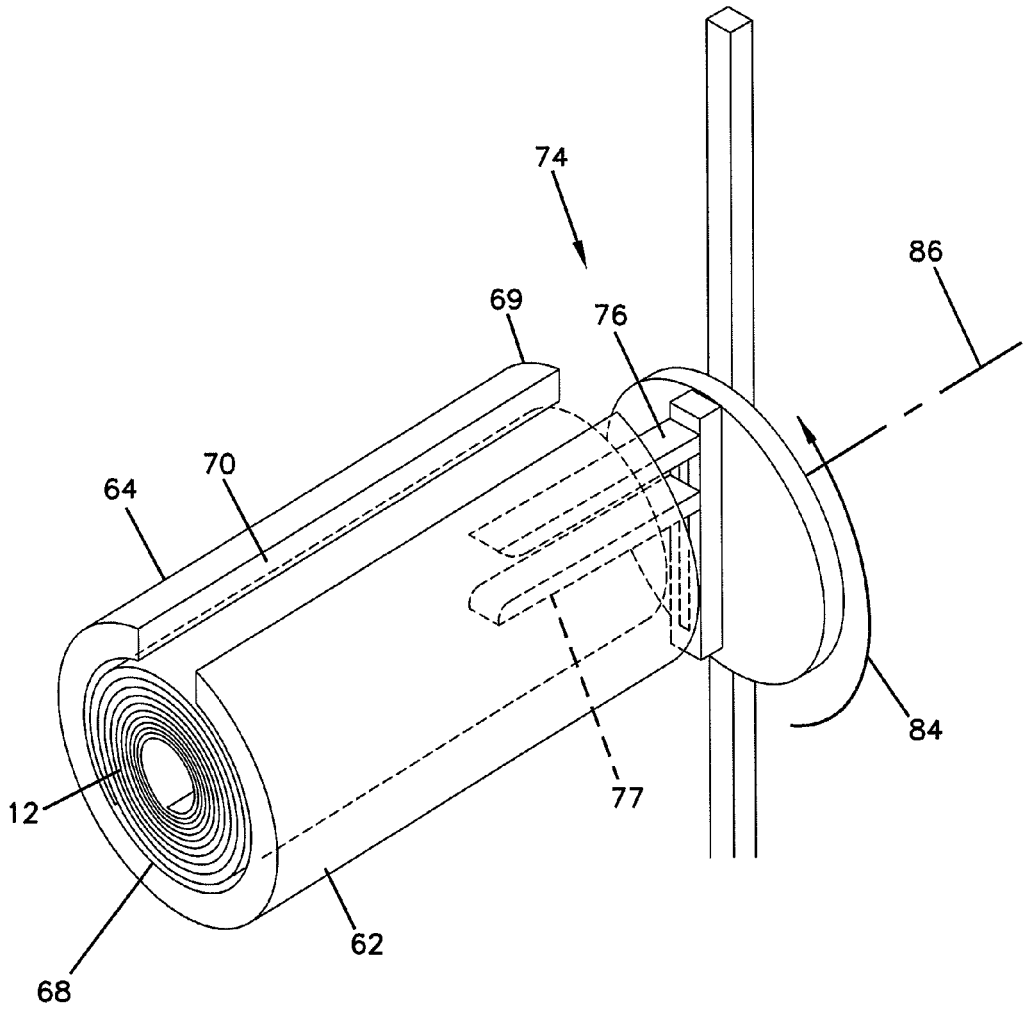
FIG. 6 is a schematic, perspective view of portions of the components of FIGS. 4 and 5 during another step of the method for packaging bags, in accordance with principles of this disclosure.

In the embodiment shown, the finger arrangement includes a pair of fingers 76, 77 (FIGS. 4-6). The fingers 76, 77 are movable in a direction shown at arrow 78 (FIG. 4) so that they are either closer to each other or farther apart from each other. Specifically, when the finger arrangement 74 is being positioned relative to the stack 58, they are initially farther apart, as shown in the phantom line version of FIG. 4. After the fingers 76, 77 are positioned to hold the stack 58 with finger 76 being on the top of the stack 58 and finger 77 being at the bottom of the stack 58, the fingers 76, 77 are moved to the position in which they are closer together so that they squeeze the stack 58 between the fingers 76, 77.

This is done as can be seen in FIG. 3, by moving the finger arrangement 74 into the nests 56. FIG. 3 does not show the stacks 58 in place, for purposes of clarity of illustration. FIG. 3 shows how the finger arrangement 74 can be moved into and out of the nests 56 in the direction of arrow 80. After the finger arrangement 74 is moved into the nest 56, finger 76 is over the top of the stack 58, while finger 77 is under the stack 58 and within the gap 60 of the respective plate 48. The fingers 76, 77 are then moved toward each other, which squeezes the stack 58.

After the stack 58 is grabbed by the finger arrangement 74, the finger arrangement 74 moves the stack 58 through the gap 60 and then through the slot 70 to the interior volume 66 of the tube 62 (FIG. 6). The finger arrangement 74 is vertically movable along arrow 82 (FIGS. 3 and 5). This allows the grabbed stack 58 to be moved in a vertically downward direction through the gap 60 and into the volume 66 of the tube 62 by moving through the slot 70.

The stack 58 of bags is then rotated to form the rolled set of bags 12. In the example system of FIG. 3, this is done by rotating the finger arrangement 74, while it is still squeezing the stack 58. FIG. 6 shows the finger arrangement 74 being rotated in a direction 84 about an axis 86. As the finger arrangement 74 rotates, it rolls, twirls, or coils the stack 8 within the tube 62 to result in the rolled set of bags 12.

Figure 7:
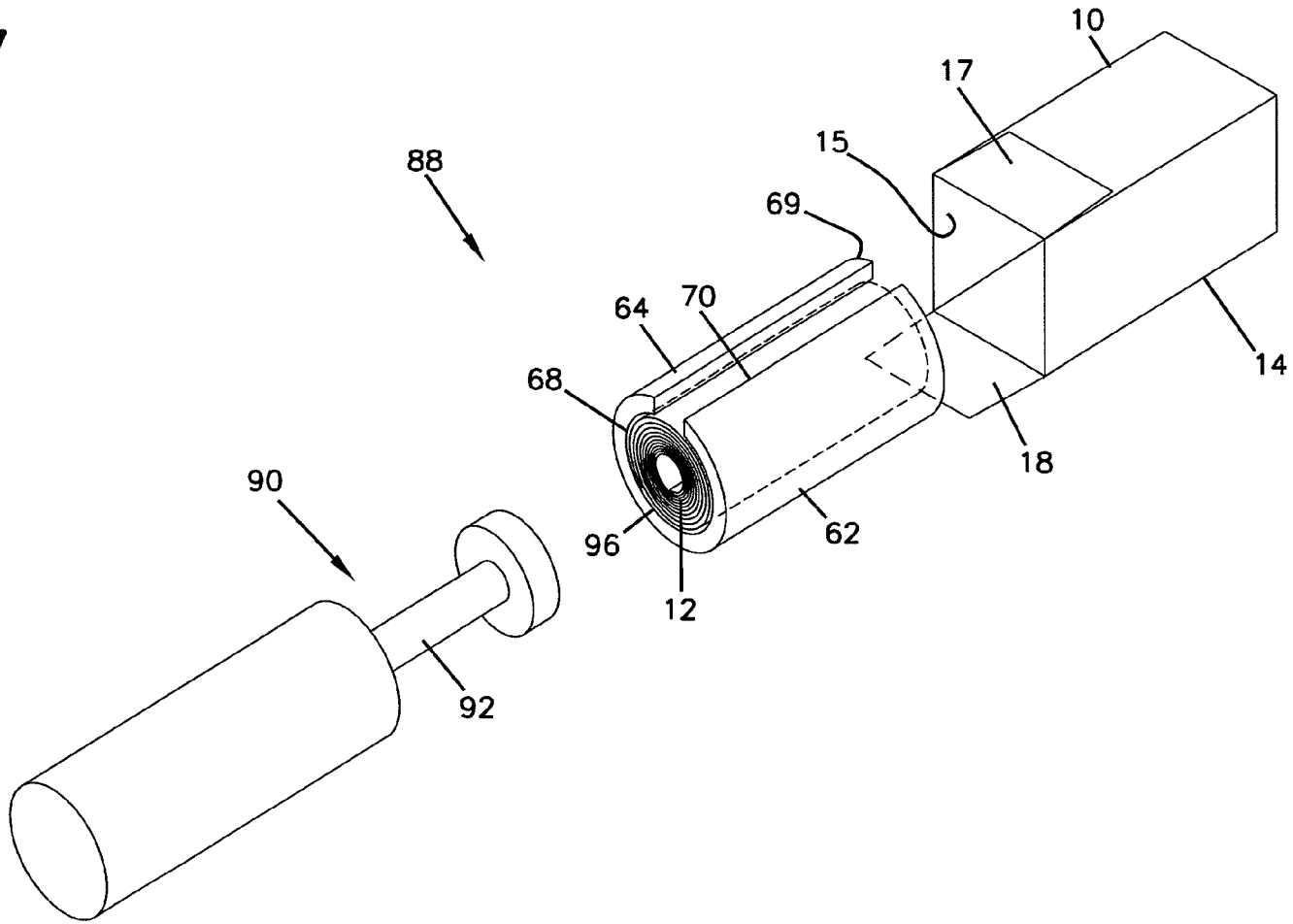
FIG. 7 is a schematic, perspective view of additional components during another step of the method for packaging bags, in accordance with principles of this disclosure.
Figure 8:
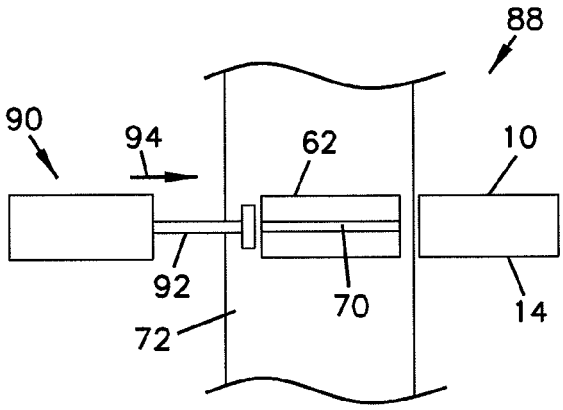
FIG. 8 is a schematic, top view of another step in the method for packaging bags, in accordance with principles of this disclosure.
Figure 9:
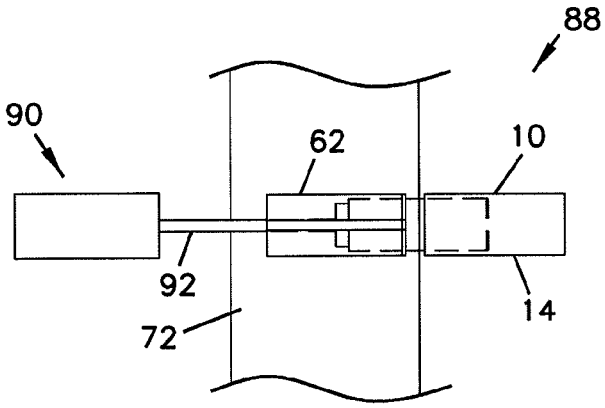
FIG. 9 is a schematic, top view of another step in the method for packaging bags, in accordance with principles of this disclosure.

After the rolled set of bags 12 is formed within the tube 62, the tube 62 containing the rolled set 12 is transported to a loading station 88 (FIGS. 7-9). In the example embodiment shown, the tube 62 holding the rolled set of bags 12 is transported by way of the conveyor belt 72. The loading station 88 includes a member 90 that is used to move the rolled set of bags 12 from the tube 62 and into the packaging container 10. In FIGS. 7-9, the example member 90 includes a pushing arm 92 that may be pneumatically (for example) operated to extend and retract relative to the rolled set of bags 12 within the tube 62. Other types of pushing arrangements can be used.

In FIG. 8, the arm 92 is shown moving in a direction of arrow 94 to engage a first axial end 96 of the rolled set of bags 12. In particular, the arm 92 is sized to penetrate the first end 68 of the tube 62, where it can touch and engage the end 96 of the rolled set 12. The arm 92 can continue to extend through the tube 62 to push the rolled set 12 from the tube 62 and into the packaging container 10.

FIG. 9 shows the arm 92 extended into the interior volume 66 of the tube 62, and with the rolled set 12 partially inserted into the packaging container 10. As the arm 92 continues to move in the direction of arrow 94, eventually the rolled set 12 is fully pushed through the second end 69 of the tube 62 and completely oriented within the packaging container 10, in the position shown in FIG. 1.

After the rolled set 12 is completely moved from the tube 62 into the packaging container 10, the packaging container 10 can be closed. In the example shown in FIG. 1, the carton 14 is closed by folding the flaps 17, 18 to cover the end 96 of the rolled set of bags 12.

Figure 11:
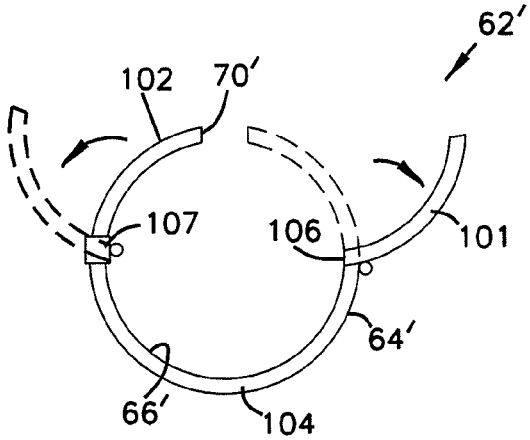
FIG. 11 is a front view of another embodiment of a tube for use in the system in the method for packaging bags, in accordance with principles of this disclosure.

An alternate embodiment of the loading tube is shown in FIG. 11 at 62'. In this embodiment, the tube 62' includes curved wall 64' defining an inner volume 66'. The wall 64' has opposite open ends, analogous to ends 68 and 69 (FIG. 4) in communication with the interior volume 66'. The wall 64' has opening or slot 70' extending longitudinally between the opposite open ends in communication with the interior volume 66' and, in this embodiment, the slot 70' is formed by a gap between first and second wall sections 101, 102 of a clam shell construction. In the illustrated embodiment, upper first and second wall sections 101, 102 of the wall 64' are pivotally or hingedly connected to lower wall section 104 by hinge constructions 106, 107. The lower wall section 104, in the embodiment shown, has a C-shaped cross-section and functions to hold the stack 58. When the stack 58 is loaded into the 62', the upper first and second wall sections 101, 102 are in an open or receiving position, which includes the wall sections 101, 102 pivoted away from each other forming the slot 70'. In FIG. 11, second wall section 102 is shown in the receiving position in broken lines, and first wall section 101 is shown in the receiving position in solid lines. After the stack 58 is loaded into the tube 62', the wall sections 101, 102 are pivoted toward each other to the closed or loaded position. The loaded position of first wall section 101 is shown in broken lines, and the loaded position of the second wall section 102 is shown in solid lines. After the clamshell of the wall sections 101, 102 is closed, the slot 70' may still be present as a gap, or it may be closed altogether if the wall sections 101, 102 touch each other. After moving the wall sections 101, 102 to the closed or loaded position, the stack 58 is rotated, as described above, and the rest of the process as described above, is the same.

In one example, one hundred bags 20 are packaged into carton 10 having dimensions of 3 in.×2.5 in.×7 in., and the time that it takes from step 36 (providing the bags in a stack) to the completion of step 42 (the bags are in the carton) is no more than 30 seconds and typically in a range of 6-20 seconds. This represents a smaller box than is typically used in prior art systems for one hundred bags 20. In this example, the one hundred bags 20 were packed into the 3 in.×2.5 in.×7 in. carton, which is typically the size carton 10 used for fifty bags 20 in the prior art system. In this example, twice the bags 20 can be packaged in the carton 10 than when the prior art system is used to package the same size bags 20.

Other embodiments will apparent to those skilled in the art from consideration of the specification and practice as disclosed herein. It is intended that the specification and examples be considered as exemplary only. Not all the specific features described herein need to be incorporated in an arrangement for the arrangement to have some selected advantage according to the present disclosure.

I claim:

1. A method for packaging bags; the method comprising:
(a) providing a plurality of bags arranged in a stack;
(b) moving the stack of bags into a tube;
(c) rotating the stack of bags in the tube to form a rolled set of bags; and
(d) moving the rolled set of bags from the tube into a packaging container.

2. The method of claim 1 wherein the step of moving the stack of bags into a tube includes moving the stack through a longitudinal slot in the tube.

3. The method of claim 1 wherein the step of moving the stack of bags into a tube includes moving the stack into a tube having a longitudinal slot formed by first and second wall sections pivoted away from each other.

4. The method of claim 1 wherein the step of moving the rolled set of bags into a packaging container includes pushing an axial end of the rolled set of bags through an open end of the tube and into the packaging container.

5. The method of claim 1 wherein:
(a) the step of providing a plurality of bags arranged in a stack includes holding the stack of bags on a plate across an open gap; and
(b) the step of moving the stack of bags into a tube includes grabbing the stack by squeezing the stack between a pair of fingers and moving the grabbed stack through the gap in the plate and through a longitudinal slot in the tube.

6. The method of claim 1 wherein the step of moving the stack of bags into a tube includes grabbing the stack by squeezing the stack between a pair of fingers.

7. The method of claim 6 wherein the step of rotating includes rotating the pair of fingers, while the pair of fingers is squeezing the stack, to rotate the stack and form the rolled set of bags.

8. The method of claim 7 further comprising the step of:
(a) after the step of rotating and before the step of moving the rolled set of bags, removing the pair of fingers from the rolled set of bags.

9. The method of claim 8 wherein the step of removing the pair of fingers from the rolled set of bags includes separating the fingers to release the squeeze.

10. The method of claim 8 further comprising the step of:
(a) after removing the pair of fingers from the rolled set of bags, transporting the tube holding the rolled set of bags to a loading station.

11. The method of claim 10 wherein the step of moving the rolled set of bags into a packaging container includes, at the loading station, using a pusher to engage through a first open end of the tube an axial end of the rolled set of bags and pushing the rolled set of bags from the tube through a second open end of the tube and into the packaging container.

12. A system for packaging bags; the system comprising:

(a) a plate having a holding surface with an open gap through the holding surface; the holding surface being sized to support a stack of bags over the open gap;

(b) a tube having a longitudinal slot oriented to receive the stack of bags;

(c) a pair of fingers positionable to squeeze the stack of bags and move the stack through the gap in the holding surface and into the tube through the slot; the fingers being rotatable to rotate the stack of bags to form a rolled set of bags while in the tube; and (d) a push member to move the rolled set of bags into a packaging container.

13. The system of claim 12 further comprising a conveyor to transport the tube to the push member.

14. The system of claim 12 wherein the tube comprises:

(a) a clamshell having a lower wall section;

(b) a first wall section pivotally attached to the lower wall section; and (c) a second wall section pivotally attached to the lower wall section;

wherein the first and second wall sections pivot away from each other to form the longitudinal slot.

* * * * *